US009370211B2

(12) United States Patent
Yee

(10) Patent No.: US 9,370,211 B2
(45) Date of Patent: Jun. 21, 2016

(54) UPPER BODY GARMENT WITH HIDDEN POCKETS

(71) Applicant: Tony M. Yee, Brookline, MA (US)

(72) Inventor: Tony M. Yee, Brookline, MA (US)

( * ) Notice: Subject to any disclaimer, the term of this patent is extended or adjusted under 35 U.S.C. 154(b) by 392 days.

(21) Appl. No.: 14/106,495

(22) Filed: Dec. 13, 2013

(65) Prior Publication Data

US 2015/0082506 A1 Mar. 26, 2015

Related U.S. Application Data

(60) Provisional application No. 61/881,250, filed on Sep. 23, 2013.

(51) Int. Cl.
*A41D 27/20* (2006.01)
*A41D 13/00* (2006.01)

(52) U.S. Cl.
CPC ..... *A41D 27/204* (2013.01); *A41D 13/0012* (2013.01); *A41D 27/208* (2013.01)

(58) Field of Classification Search
CPC ... A41D 27/20; A41D 27/201; A41D 27/204; A41D 27/205; A41D 27/208; A41D 13/0012; A41D 1/02; A41D 1/04; A41D 1/18; A41D 3/02; A41D 3/08; A41D 13/0007; A41D 27/207
USPC ..... 2/94, 247, 248, 250, 253, 254
See application file for complete search history.

(56) References Cited

U.S. PATENT DOCUMENTS 139,950 A * 6/1873 Garaud ..... A41D 13/0012 2/94
314,333 A * 3/1885 Heller ..... A41D 27/20 2/209.12
939,871 A * 11/1909 Sherman ..... A41D 13/0012 2/94
1,198,059 A * 9/1916 Ross ..... A41D 13/0012 2/94
1,505,530 A * 8/1924 Belz ..... A41D 1/04 2/248
1,797,359 A * 3/1931 Meyers ..... A45C 1/04 2/94
2,248,455 A * 7/1941 Freund ..... A41D 13/0012 2/94
2,490,857 A * 12/1949 Davidson ..... A41D 27/26 2/268
3,152,339 A * 10/1964 Conville ..... A41D 27/20 2/250
3,354,470 A * 11/1967 Allen ..... A41D 13/0012 2/94

(Continued)

FOREIGN PATENT DOCUMENTS

CN 2223905 Y 4/1996
CN 201789959 U 4/2011

(Continued)

OTHER PUBLICATIONS

Skymall; Travel Safe Women's Tank Top; web-page; downloaded Sep. 4, 2013; http://www.skymall.com/travel-safe-womens-tank-top/ZZC801.html; 3 pgs.

(Continued)

*Primary Examiner* — Amy Vanatta
(74) *Attorney, Agent, or Firm* — Davis, Malm & D'Agostine, P.C.

(57) ABSTRACT

An upper body garment includes web portions fastened to one another by a seam which is selectively openable to define one or more seam openings configured to provide user access to one or more pockets disposed along the seam on the exterior of the garment. The pockets are supported by a suspension system disposed in the interior of said garment, independently of, and in spaced relation to, the web portions. The pockets may be located along the front, side, back, and/or arm seams of the garment.

20 Claims, 8 Drawing Sheets

(56) References Cited

U.S. PATENT DOCUMENTS

| | | | | |
|---|---|---|---|---|
| 3,870,000 | A * | 3/1975 | Castany Ferre | D05B 3/10 112/475.06 |
| 4,498,200 | A | 2/1985 | Livingstone | |
| 5,255,392 | A | 10/1993 | Stanislaw | |
| 5,669,078 | A | 9/1997 | Scremin et al. | |
| 6,760,922 | B1 | 7/2004 | Morales | |
| 6,986,164 | B1 | 1/2006 | Morales | |
| 7,743,430 | B2 | 6/2010 | Jennings et al. | |
| 7,926,123 | B2 | 4/2011 | Walburg | |
| 2007/0234465 | A1* | 10/2007 | Sides | A41D 13/0537 2/94 |
| 2011/0094003 | A1 | 4/2011 | Spiewak et al. | |
| 2013/0047312 | A1* | 2/2013 | Wilson | A45F 5/02 2/69 |
| 2015/0000004 | A1* | 1/2015 | Silverberg | A41D 13/0058 2/69 |

FOREIGN PATENT DOCUMENTS

| | | | |
|---|---|---|---|
| CN | 201860791 | U | 6/2011 |
| JP | 2012202014 | A | 10/2012 |

OTHER PUBLICATIONS

Skymall; Travel Safe Men's Tank Top; web-page; downloaded Sep. 4, 2013; http://www.skymall.com/travel-safe-mens-tank-top/ZZC823.html; 2 pgs.

* cited by examiner

UPPER BODY GARMENT WITH HIDDEN POCKETS

This application claims the benefit of U.S. Provisional Patent Application Ser. No. 61/1881250, entitled Apparel Item, filed on Sep. 23, 2013, the contents of which are incorporated herein by reference in their entirety for all purposes.

BACKGROUND

1. Technical Field

This invention relates to an upper body garment, and more particularly to an upper body garment that has hidden pockets.

2. Background Information

Throughout this application, various publications, patents and published patent applications are referred to by an identifying citation. The disclosures of the publications, patents and published patent applications referenced in this application are hereby incorporated by reference into the present disclosure.

A conventional upper body garment may contain a hidden pocket or multiple hidden pockets. Hidden pockets are generally thought of being accessible from the interior of the garment. However, hidden pockets may be accessible from the outside of the garment, e.g., through a seam. One approach is to form a hidden pocket by attaching an inner liner to the outer layer of the garment. Another approach is to form a hidden pocket within the hem of the garment. However, in either case, since the pocket is connected to the outer layer of the garment, the weight of an object within the pocket tends to cause the garment to sag or stretch. Further, heavier or multiple objects within one pocket or even multiple pockets tends to intensify the sag in the wearer's garment and may cause discomfort to the wearer. This sagged or stretched garment may also defeat the purpose of the pocket being hidden.

Thus, a need exists for an improved garment with one or more hidden pockets that address the aforementioned drawbacks.

SUMMARY

In accordance with one aspect of the invention, an upper body garment with hidden pockets comprises a plurality of web portions, a plurality of pockets, and a suspension system. The plurality of web portions are fastened to one another by at least one seam extending between the web portions. The plurality of web portions fastened with at least one seam has a three-dimensional shape having an exterior and an interior. The seam can be opened to define one or more seam openings extending between the web portions. A plurality of pockets are disposed in spaced relation to one another along the seam on the interior of the garment. The plurality of pockets are accessible by a user from the exterior of the garment through the seam openings. The plurality of pockets are supported by a suspension system disposed in the interior of said garment. The plurality of pockets are supported independently of, and in space relation to, the web portions.

Another aspect of the invention includes a method for providing an upper body garment with hidden pockets. The method comprises fastening a plurality of web portions to one another by at least one seam extending between the web portions, to define a three-dimensional shape having an exterior and an interior. The seam is configured to be selectively openable to define one or more seam openings extending between the web portions. The plurality of pockets are disposed in spaced relation along the seam on the interior of the garment and configured to be accessible by a user from the exterior of the garment through the seam openings. The plurality of pockets are supported with a suspension system disposed in the interior of said garment, wherein the plurality of pockets are supported independently of, and in spaced relation from, the web portions.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

The present invention is illustrated by way of example and not limitation in the figures of the accompanying drawings, in which like references indicate similar elements and in which.

DETAILED DESCRIPTION

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. In addition, well-known structures, circuits and techniques have not been shown in detail in order not to obscure the understanding of this description. The following detailed description is, therefore, not to be taken in a limiting sense, and the scope of the present invention is defined by the appended claims and their equivalents.

Figure 1:
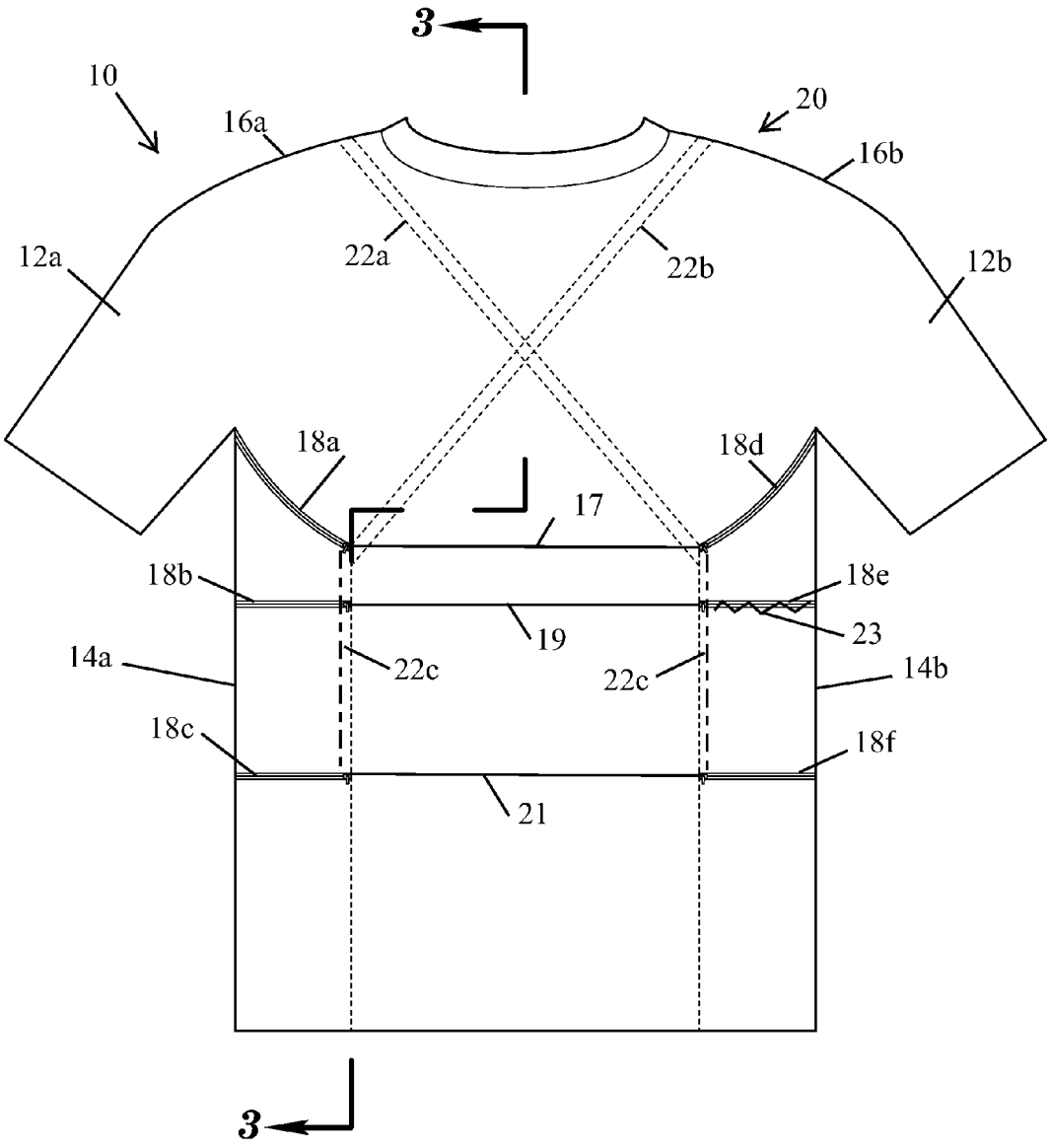
FIG. 1 is an elevational front view of an embodiment of the subject invention, with interior elements shown with hidden lines.
Figure 2:
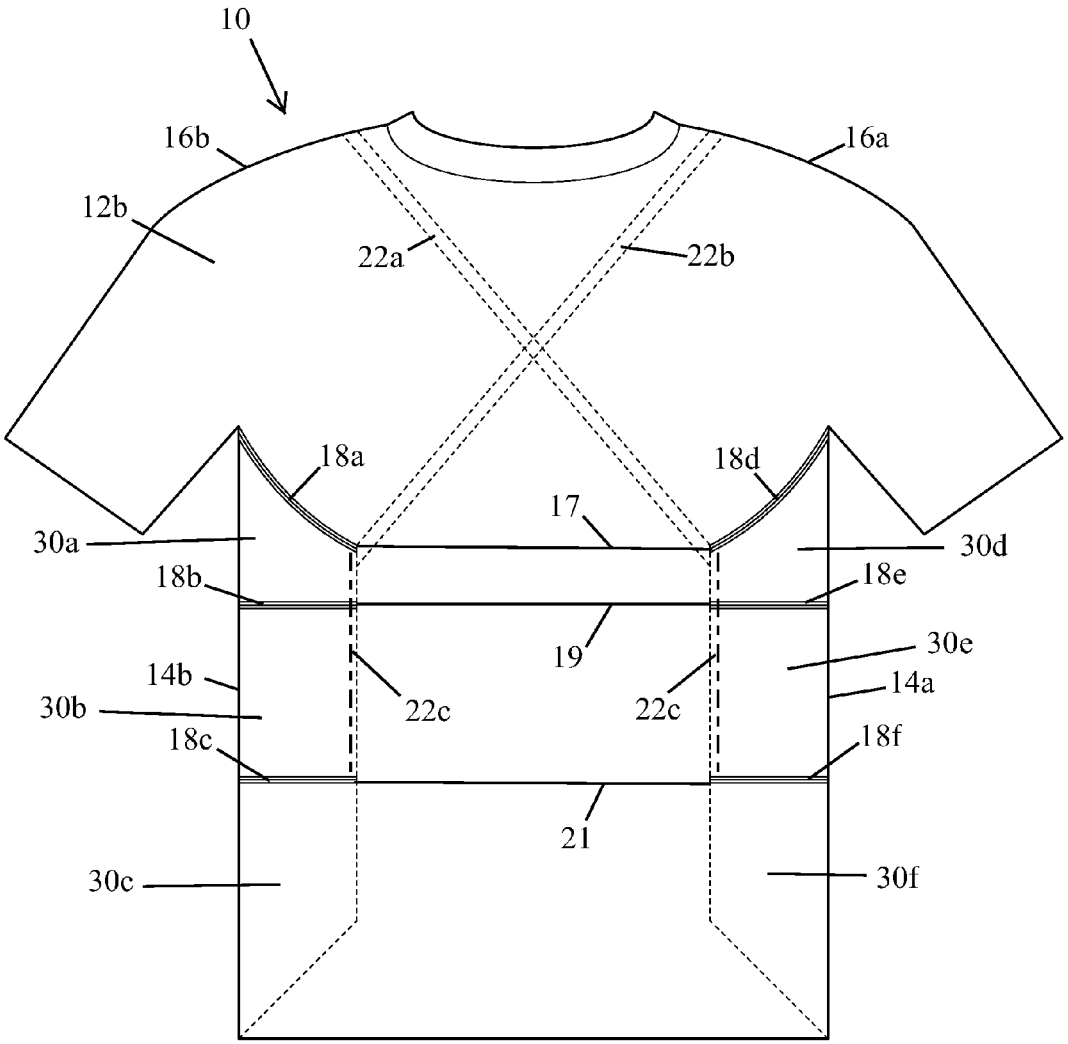
FIG. 2 is an elevational back view of the embodiment of FIG. 1, with interior elements shown with hidden lines.
Figure 3:
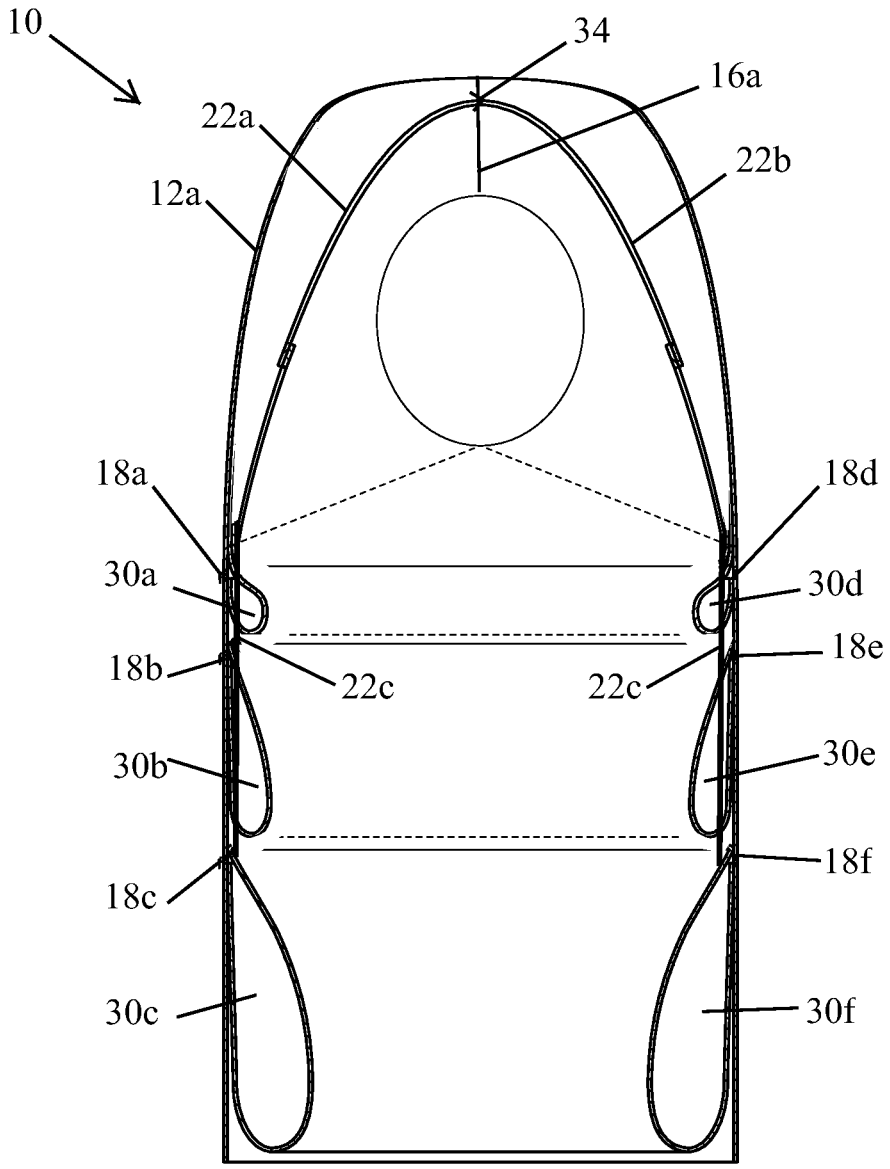
FIG. 3 is a cross-sectional, schematic view taken along 3-3 of FIG. 1.

Referring now to FIGS. 1-8, embodiments of the present invention will be described. In FIGS. 1-3, one embodiment of a garment in accordance with the present invention, includes a shirt 10 with side pockets. As shown in FIG. 1, a web portion 12*a* forms the front side of the garment, while another web portion 12*b*, (FIG. 2) forms the back side of the garment. Suitable materials for the web portions 12*a* and 12*b* can be cotton, polyester, wool, blends thereof, and/or substantially any materials that may be used now or in the future to make items of clothing. The web portions 12*a* and 12*b* are fastened to one another with stitching forming seams. For example, as shown in FIGS. 1-2, in this embodiment, side seams 14*a* and 14*b* may be disposed on opposite edges of web portions 12*a*, 12*b*, generally extending from the arm opening (e.g., the wearer's arm pit) to the waist portion of the garment. Further, shoulder seam portions 16*a* and 16*b* may extend along an upper edge of web portions 12*a*, 12*b*, e.g., along the wearer's shoulder. In addition, and/or in the alternative, the web portions 12*a*, 12*b*, may each be formed as separate sub-portions that are fastened to one another by seams, such as seams 17, 19 and 21 which may extend substantially transversely across the front and/or back of the shirt 10 as shown. The web portions 12*a* and 12*b* of the shirt thus define a three-dimensional shape having an exterior and an interior. As will be described in greater detail hereinbelow, portions of any of the seams 14*a*, 14*b*, 16*a*, 16*b*, 17, 19 and 21 may be selectively openable, e.g., by omitting stitching along those portions and optionally replacing the stitching with closures such as zippers. These selectively openable portions thus extend between web portions (or sub-portions) and may be referred to herein as "seam openings". In the embodiment of FIGS. 1-3, examples of seam openings are shown at 18*a*-18*f*.

As best shown in FIG. 3, seam openings 18*a*-*f* enable the user to access one or more hidden pockets 30*a*-30*c*. It is noted that as shown, the pockets 30*a*-30*c* are accessible by a user from the exterior of the garment 10. In the embodiment shown, a hidden pocket may be located at each of the seam openings 18*a*-*f*, so that a plurality of pockets may be disposed in spaced relation to one another along each seam 17, 19 and 21 (FIGS. 1, 2) on the interior of the garment. As will be discussed in greater detail hereinbelow, additional hidden pockets may be disposed along, and accessed through seam openings in other seams, such as seams 14*a*, 14*b*, 16*a* and/or 16*b*.

For practical purposes, the pockets 30*a*-30*f*, etc., may be constructed out of the same material as the web portions 12*a* and 12*b*, or of a different material such as canvas or reinforced webbing in order to provide additional support as may be desired for any particular application. For example, pockets intended for receiving a user's wallet and/or keys may be constructed from heavier material than pockets intended for receiving a user's credit card or driver's license.

In this embodiment, each of the hidden pockets 30*a*-30*f* is formed from a single sheet of material folded over on itself to form a loop as shown in cross-section, and fastened, e.g., by stitching, on opposite sides of seam openings 18*a*-18*f*, respectively. In this manner, access to the pockets may be gained through the seam openings. It should be noted that the sides of the pockets may be closed in a conventional manner, such as by vertical stitching shown, for example, in FIGS. 4 and 6. Although fabricating each pocket from a single sheet may be desireable for some applications, it should be recognized that the pockets may be formed from multiple sheets of material fastened to one another, e.g., by stitching. Moreover, although shirt 10 is shown with six hidden pockets, it should be recognized that any number of pockets may be provided.

The pockets 30 are supported by a suspension system 20 disposed in the interior of the garment. As shown in FIGS. 1-2, the suspension system 20 includes support members 22*a*, 22*b* and 22*c*. Support members 22*a* and 22*b* may extend from the user's shoulders, e.g., from shoulder seam portions 16*a* and 16*b*, to pockets 30*a* and 30*d*. As shown, support members 22*a*, 22*b* may extend along both web portions 12*a* and 12*b*, to effectively form suspenders extending over the front and back of the user's shoulders. Alternatively, in the event pockets are only desired on one side of the garment 10, the support members may only be needed on one side (e.g., the front) of the garment.

In particular embodiments, the support members 22*a*, 22*b* may be stitched to shoulder seam portions 16*a* and 16*b*, e.g., at 34 (FIG. 3) and to the pockets 30*a* and 30*d*, respectively. Support members 22*c* may respectively extend from the pockets 30*a* and 30*d*, to pockets 30*b* and 30*e*, and to pockets 30*c* and 30*f*, as shown. The support members may be fastened to the pockets in any convenient location, such as at substantially the same location at which the pockets are secured to their respective seam openings. For example, in the particular example shown, the support members are fastened to the pockets approximately at the ends the seam openings. It should be recognized, however, that the support members may be secured substantially anywhere on the pockets, including, but not limited to, the seam openings.

It is noted that the support members may be fabricated from any suitable material, such as the same material used for web portions 12*a*, 12*b*. In some embodiments, the fabric of support members 22*a*, 22*b* may be elastic for added comfort and/or support to the pockets 30.

The support members 22*a*, 22*b*, 22*c* allow the pockets 30 to be supported independently of, and in spaced relation to, the web portions 12*a* and 12*b*, in the interior of the garment. And, in the particular embodiment shown, it should be recognized that each of the pockets are effectively supported from the wearer's shoulder, i.e., via shoulder seam portions 16*a*, 16*b*. Advantageously, supporting pockets 30 in this manner, rather than by web portions 12*a* and 12*b*, allows the shirt 10 to be kept from sagging or stretching from the weight of the contents of the pockets. Moreover, maintaining the pockets in spaced relation from the web portions 12*a* and 12*b*, helps to conceal the pockets from view. For example, because the pockets are supported by support members 22*a*, 22*b*, 22*c*, the web portions 12*a*, 12*b* may be sized and shaped for a relatively loose fit on the user, to help obscure the presence of items within the pocket. This aspect may be useful, for example, for travelers in areas known to be popular with pickpockets, etc.

Although the support members are shown in a crossed suspenders configuration, it should be recognized that any number of configurations may be provided, while remaining within the scope of the present invention. For example, members 22*a*, 22*b* may be disposed in an uncrossed suspender configuration. In addition, instead of relatively slender strap-like portions, members 22*a*, 22*b*, 22*c* may be fabricated as a continuous inner layer of garment 10, disposed in spaced relation from the outer web portions 12*a*, 12*b*, etc.

The embodiment of FIGS. 1-3 illustrates hidden pockets disposed at various locations along the front web portion 12*a*, and/or the back web portion 12*a*. However, hidden pockets may be disposed at any number of locations, such as along one or both side seams 14*a*, 14*b*, along a chest seam 42 (FIG. 4), and/or directly along shoulder seam portions 16*a*, 16*b*, such shown and described hereinbelow. Moreover, although the embodiment shown and described includes two pockets disposed at opposite ends of seams 17, 19 and 21, it should be recognized that pockets may be disposed at substantially any location along the seams, including between the pockets 30*a* and 30*d*, etc., while remaining within the scope of the present invention.

One or more fasteners 23, such as shown schematically at seam opening 18*e*, may be provided to selectively open and close any of the pockets. Substantially any type of fasteners 23 known to those skilled in the art may be used, including a zipper, a button, or hook and loop fasteners such as those sold under the VELCRO® trademark (Velcro Industries, B.V., 406

Brown Avenue, Manchester, N.H. 03103). In the example shown, fastener 23 is a zipper configured to extend along the length of seam opening 18*e*.

Figure 4:
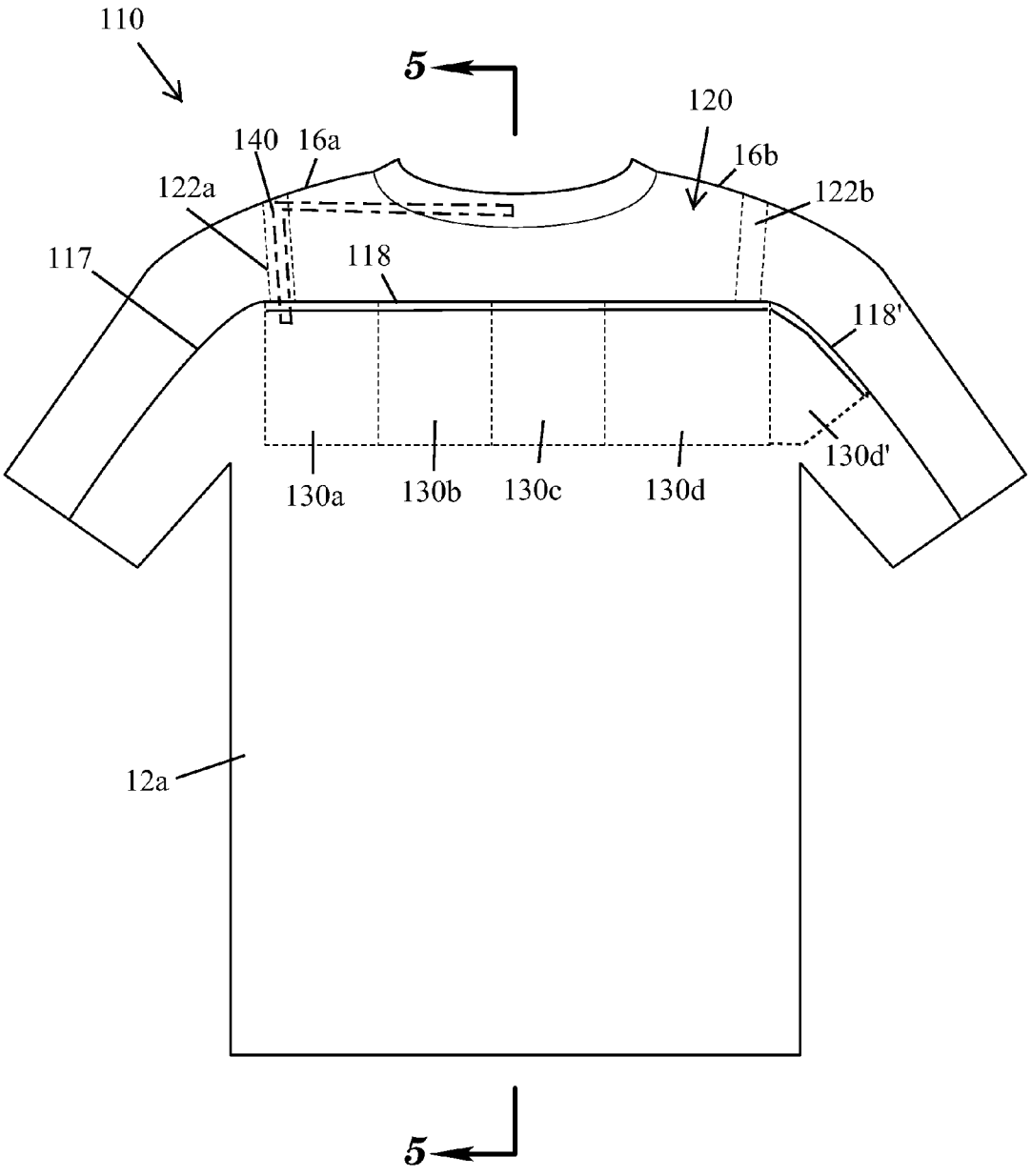
FIG. 4 is a view similar to that of FIG. 1, of an alternate embodiment of the present invention.
Figure 5:
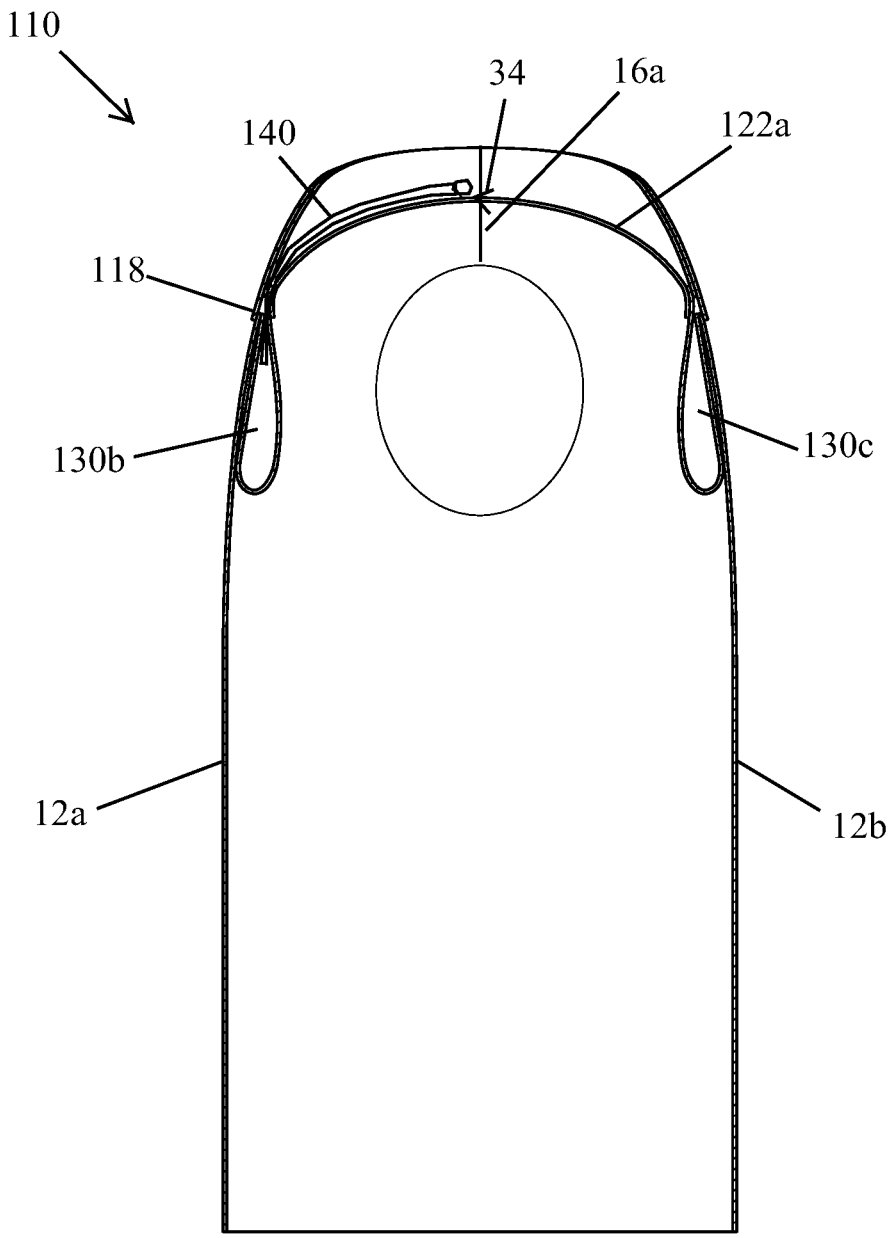
FIG. 5 is a cross-sectional, schematic view taken along 5-5 of FIG. 4.

Referring to FIGS. 4-5, another embodiment of the invention is shown as a shirt 110. Shirt 110 is in many respects substantially similar or identical to shirt 10, with similar reference numerals representing similar elements. In this embodiment, a chest seam 117 extends along a chest area of the garment. Chest (and/or sleeve) pockets 130*a*-130*d* are disposed along chest seam 117, and are otherwise substantially similar to pockets 30*a*-30*f*. The chest pockets are accessible from the exterior of the garment through a chest seam opening 118. Similar to that included in shirt 10, the chest pockets 130*a*-130*d* are supported by a suspension system 120 disposed in the interior of the garment 110. In this embodiment, the suspension system 120 includes two support members 122*a* and 122*b* that are secured to the edges of the outer chest pockets 130*a* and 130*d*, d 52*b* and to shoulder seam portions 16*a* and 16*b*, in any convenient manner, such as by stitching 34. In this embodiment, the pockets 130*a*-130*d* are fabricated as a unitary array in which adjacent pockets are secured to one another. For example, in a particular embodiment, the pockets 130*a*-130*d* may be initially fabricated as a single pocket extending from support member 122*a* to 122*b*, which is then divided into a plurality of separate pockets, such as by a series of vertical rows of stitching. In this manner, the chest pockets 130*a*-130*d* are each supported independently of, and in spaced relation to, the web portions 12*a* and 12*b*. As shown, the support members 122*a* and 122*b* extend substantially vertically, however, in particular embodiments, it may be desirable to configure them to cross over one another, such as shown in FIG. 1. In addition, it should be recognized that pockets 130*a*-130*d* may be disposed on only a single side (e.g., accessed from the front web portion 12*a*), or alternatively, on both sides of the garment, such as by including a second array of pockets accessible from the back web portion 12*b* as shown in FIG. 5. Moreover, although pockets 130*a*-130*d* have been shown and described as chest (and/or back) pockets, one skilled in the art should recognize that substantially similar pockets may located on the sleeve portion of seam 117, and accessible via seam opening 118', such as shown at 130*d*', while still being supported by support members 122*a*, 122*b*, as shown. Still further, although support members 22*a*, 22*b*, 122*a*, 122*b*, are shown and described as being secured to the shoulder seam portions 16*a*, 16*b*, the skilled artisan will recognize that it may not be necessary to secure the support members to the shoulder seams, such as in the event both front and rear pockets are provided and the support members are configured to extend over the user's shoulders from the front pockets to the rear pockets.

Figure 6:
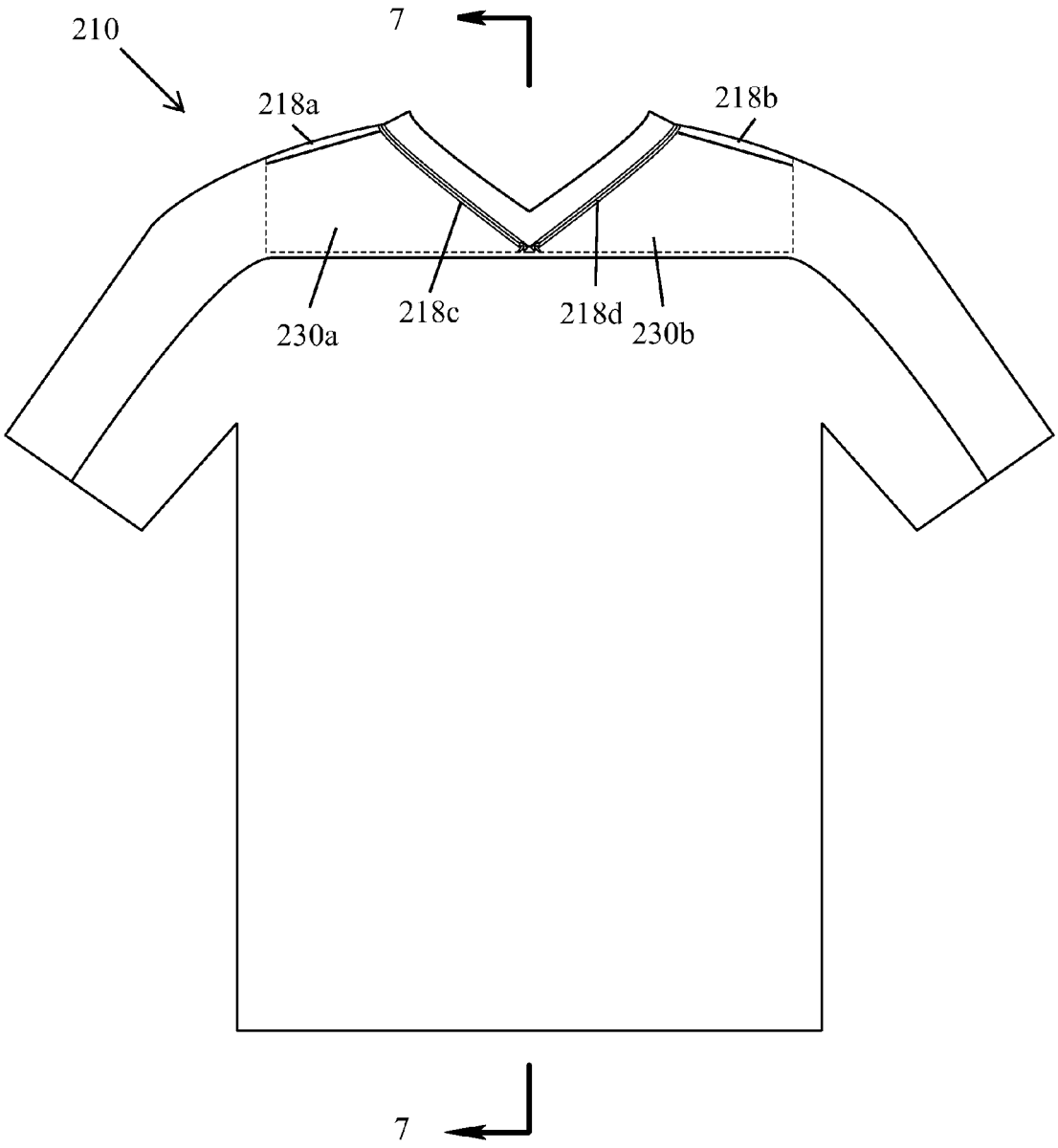
FIG. 6 is a perspective view similar to that of FIG. 1, of yet another embodiment of the present invention.
Figure 7:
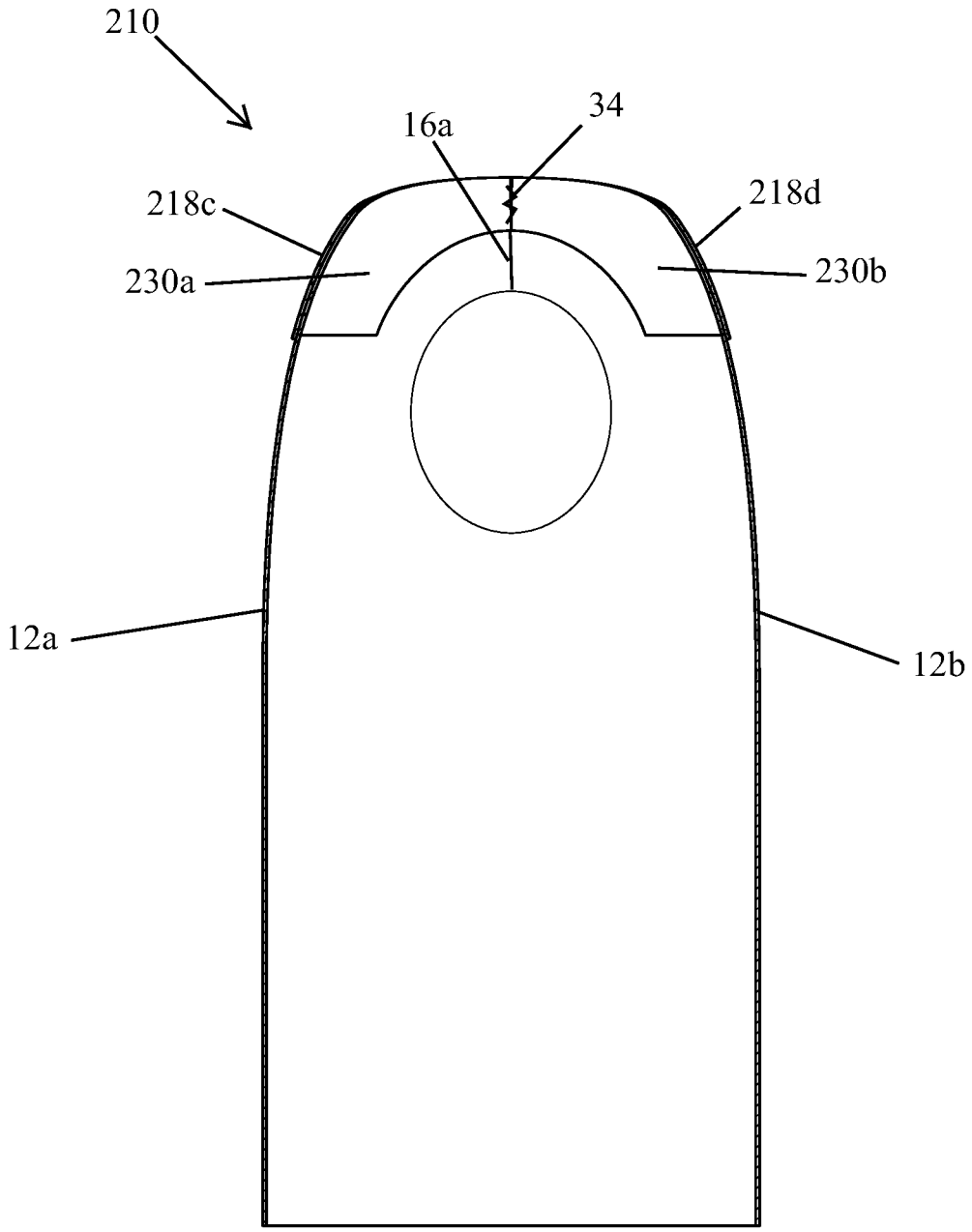
FIG. 7 is a cross-sectional, schematic view taken along 7-7 of FIG. 6.

Referring to FIGS. 6-7, another embodiment of the invention, a shirt with collar pockets 210, is shown. Collar pockets 230*a* and 230*b* are disposed in spaced relation to one another along the shoulder seam, e.g., pocket 230*a* extends along shoulder seam portion 16*a*, while pocket 230*b* extends along shoulder seam portion 16*b*. The collar pockets 230*a* and 230*b* are accessible by a user from the exterior of the garment through collar seam openings 218*a* and 218*b*. In addition, and/or in the alternative, the pockets may be accessible via collar seam openings 218*c* and 218*d*. As seen in FIG. 7, the support member 66 in this embodiment may include stitching 34 configured to fasten the collar pockets 230*a* and 230*b* to the shoulder seam portions 16*a* and 16*b* beyond the seam openings. As with the foregoing embodiments, pockets 230*a* and/or 230*b* may be disposed on one side of the shirt, such as shown in FIG. 6, or on both sides 12*a*, 12*b* of the shirt as shown in FIG. 7.

Figure 8:
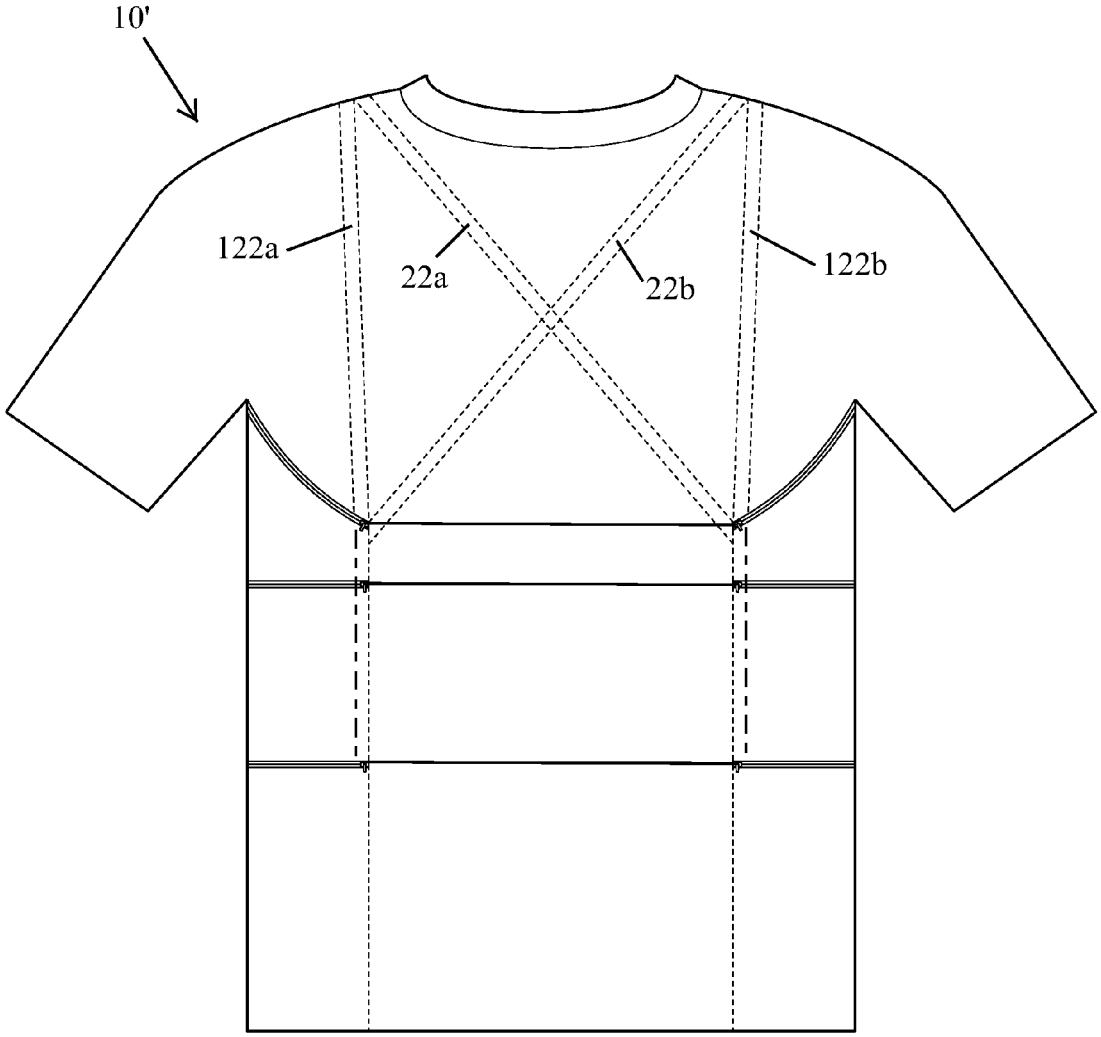
FIG. 8 is a view similar to that of FIG. 1, of yet another embodiment of the present invention.

Particular embodiments of the present invention may include any combination of side pockets 30*a*-30*f*, chest pockets 130*a*-130*d*, or collar pockets 230*a*, 230*b*, etc. For example, a shirt with side pockets 30*a*, etc., and chest pockets 130*a*, etc., may all be supported by the same suspension system 20. In such an embodiment, the fabric of the support member 20 may be fastened to the side pockets, the chest pockets and shoulder seam portions 16*a*, 16*b*. In another example, side pockets, chest pockets, and collar pockets may all be supported by the same support member. As shown in FIG. 8, a shirt 10' may combine aspects of the suspension systems of garments 10 and 110, e.g., using support members 22*a*, 22*b*, and 122*a*, 122*b*. Further, the garment need not be a shirt, but can be any upper body garment such as a sweater, blouse, or jacket, etc.

Moreover, although shown and described with respect to T-shirts, the skilled artisan should recognize that aspects of the invention may be applied to any number of garment types, including athletic wear for runners, walkers, etc. Embodiments may even be provided for pets and service animals, in which the pockets may be used to store identification and/or medication, etc.

Particular embodiments may be provided with waterproof pockets for cell phones and the like. For example, embodiments may be configured as a casual t-shirt or polo shirt suitable for being worn in and around boats, the pool, the beach, etc., with one or more of the pockets being waterproof to protect valuables in the event the wearer falls into the water or gets caught in the rain, etc.

Still other embodiments may enable one or more of the hidden waterproof pockets to be inflatable, such as by an inflation tube integrated within the suspension system. For example, referring back to FIGS. 4 and 5, one or more of pockets 130*a*-130*d* may be fabricated as a single, or series of interconnected, waterproof and air-tight pocket(s). The waterproofing may be provided by use of any number of thin, lightweight, water-tight and air-tight materials, such as a rubberized fabric. A one-way blow tube 140 may be supported by, and extended along, the support member 122*a*, to an area accessible by the user to inflate the waterproof pocket(s). For example, in particular embodiments, tube 140 may extend into a collar portion of the shirt 110, as shown in FIG. 4, where it may protrude from a slit or other opening on the interior of the shirt for user access. When desired, such as in the event the user falls into the water, the user may simply lift the front of the collar portion to the mouth and blow into the end of the blow tube 140 to inflate the pocket(s) 130*a*-130*d*. Such use of inflatable pockets may effectively enable the garment to function as a life-vest effectively hidden within in a t-shirt or polo shirt. Moreover, although shown and described with respect to pockets on the front side of the garment proximate web portion 12*a*, it should be recognized that the blow tube 140 may be configured to also (or alternatively) inflate pockets 130*a*-130*c* on the back side of the garment proximate web portion 12*b*. Still further, in an alternate version of this embodiment, shoulder pockets, such as shown and described at 320*a* and 230*b* of FIG. 6, may be used to help conceal the user-accessible end of tube 140, which may be accessed through seam openings 218*c*, 218*d* for inflation of the pockets.

Having shown and described various embodiments of the present invention, an exemplary method 300 of the present invention will be described with reference to the following Table 1.

TABLE 1

| | |
|---|---|
| 350 | fasten web portions to one another with a seam |
| 352 | configure the seams to be selectively openable to define one or more seam openings |
| 354 | dispose pockets in spaced relation along the seam |
| 356 | configure the pockets to be accessible from the exterior of the garment through seam opening |
| 358 | support pockets with a suspension system independently of the web portions |

Turning to Table 1, a method 300 for providing an upper body garment such as shown and described with respect to FIGS. 1-8, includes fastening 350 a plurality of web portions to one another by at least one seam extending therebetween, to define a three-dimensional shape having an exterior and an interior. At 352, the seam is configured to be selectively openable to define one or more seam openings extending between the web portions. At 354, a plurality of pockets are disposed in spaced relation along the seam on the interior of the garment. At 356, the pockets are configured to be accessible by a user from the exterior of the garment through the seam opening(s). At 358 the pockets are supported with a suspension system disposed in the interior of the garment, so that the plurality of pockets are supported independently of, and in spaced relation from, the web portions.

It should be further understood that any of the features described with respect to one of the embodiments described herein may be similarly applied to any of the other embodiments described herein without departing from the scope of the present invention.

In the preceding specification, the invention has been described with reference to specific exemplary embodiments for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

Having thus described the invention, what is claimed is:

1. An upper body garment with hidden pockets comprising:

a plurality of web portions fastened to one another by at least one seam extending therebetween, to define a three-dimensional shape having an exterior and an interior;

the seam being selectively openable to define one or more seam openings extending between said web portions;

one or more pockets disposed along the seam on the interior of the garment;

said one or more pockets being accessible by a user from the exterior of the garment through said one or more seam openings;

said one or more pockets being supported by a suspension system disposed in the interior of said garment, wherein said one or more pocket is supported independently of, and in spaced relation to, the web portions.

2. The garment of claim 1, wherein the one or more pockets comprises a plurality of pockets disposed in spaced relation to one another along the seam on the interior of the garment.

3. The garment of claim 2, further comprising one or more fasteners configured to selectively open and close said plurality of pockets.

4. The garment of claim 3, wherein the one or more fasteners are selected from the group consisting of a zipper, a button, or hook and loop fasteners.

5. The garment of claim 3, wherein the one or more fasteners comprises a zipper extending along the seam.

6. The garment of claim 3, wherein the at least one seam comprises a shoulder seam configured to extend along a top of a wearer's shoulder.

7. The garment of claim 6, wherein the suspension system comprises a support member configured to secure the plurality of pockets to the shoulder seam independently of the web portions.

8. The garment of claim 7, wherein the plurality of pockets comprise collar pockets disposed in spaced relation along the shoulder seam, and said support member comprises stitching configured to fasten the collar pockets to the shoulder seam beyond said seam openings.

9. The garment of claim 7, wherein the support member comprises a strap extending from the shoulder seam to the plurality of pockets.

10. The garment of claim 9, wherein the strap comprises an interior web portion configured to form an inner layer disposed in spaced relation to said plurality of web portions.

11. The garment of claim 9, wherein the at least one seam further comprises a side seam extending between an arm opening portion and a waist portion of said garment, and the plurality of pockets are disposed along said side seam.

12. The garment of claim 11, further comprising another side seam extending between another arm opening and the waist portion of said garment, and the plurality of pockets are disposed along said side seam and said other side seam.

13. The garment of claim 12, wherein the at least one seam further comprises a chest seam extending along a chest area of the garment, and the plurality of pockets are disposed along said chest seam.

14. The garment of claim 13, wherein the plurality of pockets further comprise collar pockets disposed in spaced relation along the shoulder seam, and said support member further comprises stitching configured to fasten the collar pockets to the shoulder seam beyond said seam openings.

15. The garment of claim 9, wherein the at least one seam further comprises a back seam extending along a back area of the garment, and the plurality of pockets are disposed along said back seam.

16. The garment of claim 9, wherein the at least one seam further comprises a chest seam extending along a chest area of the garment, and the plurality of pockets are disposed along said chest seam.

17. The garment of claim 1, wherein said one or more pockets comprises a waterproof pocket.

18. The garment of claim 17, wherein said waterproof pocket is configured to be substantially air-tight.

19. The garment of claim 18, further comprising a blow tube extending from said waterproof pocket along said suspension system, the blow tube configured for being accessed by the user to inflate the waterproof pocket.

20. A method for providing an upper body garment with hidden pockets, the method comprising:

(a) fastening a plurality of web portions to one another by at least one seam extending therebetween, to define a three-dimensional shape having an exterior and an interior;

(b) configuring the seam to be selectively openable to define one or more seam openings extending between the web portions;

(c) disposing a plurality of pockets in spaced relation along the seam on the interior of the garment;

(d) configuring the plurality of pockets to be accessible by a user from the exterior of the garment through said one or more seam openings;

(e) supporting the plurality of pockets with a suspension system disposed in the interior of said garment, wherein the plurality of pockets are supported independently of, and in spaced relation from, the web portions.

* * * * *